US005594541A

United States Patent [19]

Bonislawski, Jr. et al.

[11] Patent Number: 5,594,541

[45] Date of Patent: Jan. 14, 1997

[54] CLEANER/WASTE BOTTLE INTERFACE SEALING VIA TONER VALVE

[75] Inventors: John M. Bonislawski, Jr., Ontario; Bruce E. Thayer; Dennis G. Gerbasi, both of Webster, all of N.Y.

[73] Assignee: Xerox Corporation, Stamford, Conn.

[21] Appl. No.: 352,485

[22] Filed: Dec. 9, 1994

[51] Int. Cl.[6] ..... G03G 21/00

[52] U.S. Cl. ..... 399/358; 399/102

[58] Field of Search ..... 355/298, 260, 355/200, 296, 297, 245; 222/DIG. 1

[56] References Cited

U.S. PATENT DOCUMENTS

| | | | |
|---|---|---|---|
| 4,030,824 | 6/1977 | Smith | 355/298 |
| 4,625,895 | 12/1986 | Tsukano | 222/63 |
| 4,849,791 | 7/1989 | Hagihara et al. | 355/298 |
| 5,038,180 | 8/1991 | Niki | 355/298 |
| 5,109,254 | 4/1992 | Oka et al. | 355/200 |
| 5,132,740 | 7/1992 | Okamoto et al. | 355/298 |
| 5,237,373 | 8/1993 | Aimoto et al. | 355/298 |
| 5,349,427 | 9/1994 | Benedict et al. | 355/298 |
| 5,452,066 | 9/1995 | Marotta et al. | 355/298 |

*Primary Examiner*—Thu A. Dang
*Attorney, Agent, or Firm*—T. L. Fair

[57] ABSTRACT

An apparatus and method that uses a toner valve to seal the interface between a cleaner housing and waste container. The toner valve incorporates a two piece valve of which the larger, called the main valve, is housed in the cleaner housing, and the smaller, called the lid, is housed in the top of the waste container. When the waste container is inserted onto the cleaner housing, the main valve of the cleaner housing is coupled to the lid of the waste container. A handle extending from a shaft in the main valve enables movement of the complete toner valve. The coupling of the two piece toner valve enables the toner valve to work as a single unit when the handle is rotated, opening the waste container and the cleaner housing and providing a totally sealed open path for the toner to fall from the cleaner housing to the waste container. Further rotation of the two piece toner valve closes both the cleaner housing and the waste container. The main valve seals the cleaner housing preventing toner from escaping and the lid seals the waste container preventing toner from spilling upon removal from the cleaner housing.

16 Claims, 9 Drawing Sheets

CLEANER/WASTE BOTTLE INTERFACE SEALING VIA TONER VALVE

BACKGROUND OF THE INVENTION

This invention relates generally to a cleaning apparatus, and more particularly concerns a valved toner waste bottle apparatus for collecting particles removed from the photoreceptor surface by a cleaner.

In an electrophotographic application such as xerography, a charge retentive surface (i.e. photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (i.e. an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g. paper), and the image affixed thereto to form a permanent record of the image to be reproduced. Subsequent to development, excess toner left on the charge retentive surface is cleaned from the surface.

Xerographic cleaning subsystems remove residual toner particles from the photoreceptor surface by a variety of methods (e.g. blades, brushes, air, etc.). The toner particles removed by these cleaning methods are stored in a waste toner bottle until the container can be removed from the cleaner. A common problem that occurs upon removal of the waste container from the printer or copier machine is the spilling of toner particles from the waste container in the machine prior to and upon removal from the waste container as well as toner leakage of the toner particles as they fall from the cleaner housing to the waste container.

The following disclosures may be relevant to various aspects of the present invention and may be briefly summarized as follows:

U.S. Pat. No. 5,349,427 to Benedict et al. which discloses a sealed system for collecting and removing waste imaging material from a reproduction apparatus in a waste collection container removably insertable into the reproduction apparatus so that the inlet opening of the container is positioned at discharge outlet of a pneumatic cleaning system, especially, the outlet of a cyclone air/toner separator. The container has a dual mode resilient pneumatic seal surrounding its inlet, and an integral insertion guide member. The cleaning system discharge outlet includes a spring loaded sled member and a flexible pneumatic seal connecting between the sled member and the discharge outlet to allow limited movement of the sled member. The insertion guide member of the container sides on an entrance guide path into compressed superposed engagement with the sled member to form a pneumatically-sealed waste material path between the discharge outlet of the reproduction apparatus cleaning system and the interior of the waste container when so inserted. Also provided is a cap for sealing the inlet opening of the container when the container is removed by engagement with the same, dual mode resilient pneumatic seal surrounding the inlet opening of the container. Also, a mating detent system is provided, which also protects the seal.

U.S. patent application Ser. No. 08/229,942 to Owens which discloses removal of a customer replaceable cleaner subsystem from the electrostatographic machine without spillage of toner and other debris particles. The cleaning unit, including a disturber brush and a retractable cleaning blade, is slidably inserted or removed from the machine. The cleaning unit is removed from the machine when a cleaning failure occurs and replaced by a readily available spare cleaning unit. When the cleaning unit is inserted into the machine, adjacent to the photoreceptor, a door panel is slidably opened as the cleaning unit is moved into the appropriate space. The blade is moved into an engaged position with the photoreceptor for cleaning. When the cleaning unit is removed from the printer machine, the blade is retracted and the door panel is slidably closed as the cleaning unit is being removed, providing self-sealing of the cleaner unit and preventing toner and other debris spillage.

SUMMARY OF INVENTION

Briefly stated, and in accordance with one aspect of the present invention, there is provided a printing apparatus for cleaning particles from a surface. The printing apparatus comprises means for cleaning particles from the surface and a housing defining a chamber having a first open end and a second open end. The cleaning means being mounted in the chamber of the housing, with a portion thereof being adapted to extend from the first open end of the chamber into contact with the surface. The printing apparatus also comprises a waste container attached to the second open end of the housing, for collecting particles removed from the surface by the cleaning means, movable between a closed position and an open position for sealing the second open end of the housing and the waste container.

Pursuant to another aspect of the present invention, there is provided a method of sealing an interface between a cleaner housing and a waste container. The method comprises: coupling the waste container and the cleaner housing of a printing machine to one another; opening the interface between the cleaner housing and the waste container enabling particles to flow from the cleaner housing to the waste container; closing the interface between the cleaner housing and the waste container to prevent particles from escaping the cleaner housing and the waste container; and separating the waste container and cleaner housing from one another.

Pursuant to another aspect of the present invention, there is provided a cleaning unit having an operator replaceable waste container adapted to collect particles cleaned from a surface. The cleaning unit comprises a device for cleaning particles from the surface and a housing defining a chamber having a first open end and a second open end. The cleaning device, being mounted in the chamber of said housing, with a portion thereof being adapted to extend from the first open end of the chamber into contact with the surface. The waste container, attached to the second open end of the housing, for collecting particles removed from the surface by the cleaning device. The cleaning unit also includes a device, movable between a closed position and an open position, for sealing the second open end of the housing and the waste container.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color (or black) electrostatographic printing or copying machine with gravity waste feed toner collection, it should become evident from the following discussion, that it is equally well suited for use in a wide variety of devices and is not necessarily limited to the particular embodiments shown herein.

Figure 10:
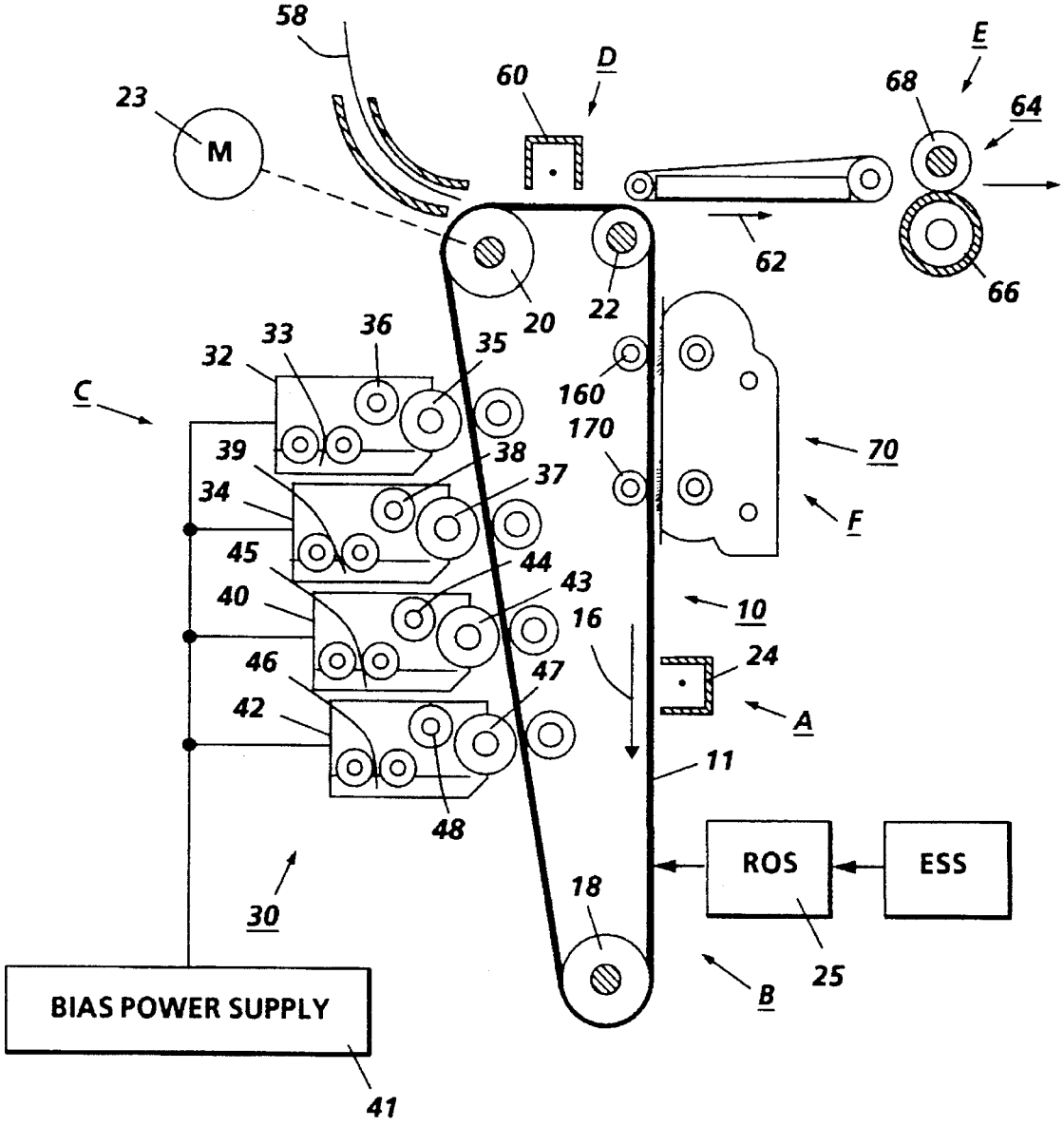
FIG. 10 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 10 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 10, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two-level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase depending upon the number of colors, i.e. for four colors there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that the development housings 32, 34, 40, and 42 must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush(es), blade(s), hybrid, air, or other type of cleaning system 70. The cleaning system is supported under the photoreceptive belt by two backers 160 and 170.

The present invention discloses using a valve concept, which will be referred to herein as a toner valve, to seal the interface between the bottom of a cleaner apparatus and the waste bottle container. The toner valve is a two piece construction with the larger piece, which will be referred to hereinafter as the main valve 200 (see FIG. 1), being housed in the cleaner housing, and the smaller portion, which will be referred to hereinafter as the lid 210 (see FIG. 1) being housed in the top portion of the waste container. When the waste container is inserted into the copier and a handle is rotated, the two pieces of the toner valve construction work as one to open the waste container and provide a totally sealed, open path for toner to fall from the cleaner into the waste bottle container. This apparatus is simple to operate (i.e. because of a two step process with self alignment features), and maintains clean external surfaces and thus allows the waste bottle container to be easily replaced by the customer. Other advantages of the present invention include the ability of the toner valve apparatus: to be adapted to any gravity fed toner collection cleaning system; to be reused in a new copier if the seals are replaced; to prevent toner emissions due to the seals; and to allow the waste bottle to become a CRU (customer replaceable unit) without risk of toner spillage on the customer when the waste bottle container is replaced. The risk of toner spillage is alleviated due to the concept of the toner valve of the present invention, in which two pieces (i.e. the main valve and the lid) come together to act as one and provide an effective seal between a cleaner and waste bottle container. However, in addition to an effective seal, the toner valve can be used as the interface between the cleaner and waste container on any cleaner that utilizes gravity feed toner collection.

Figure 1:
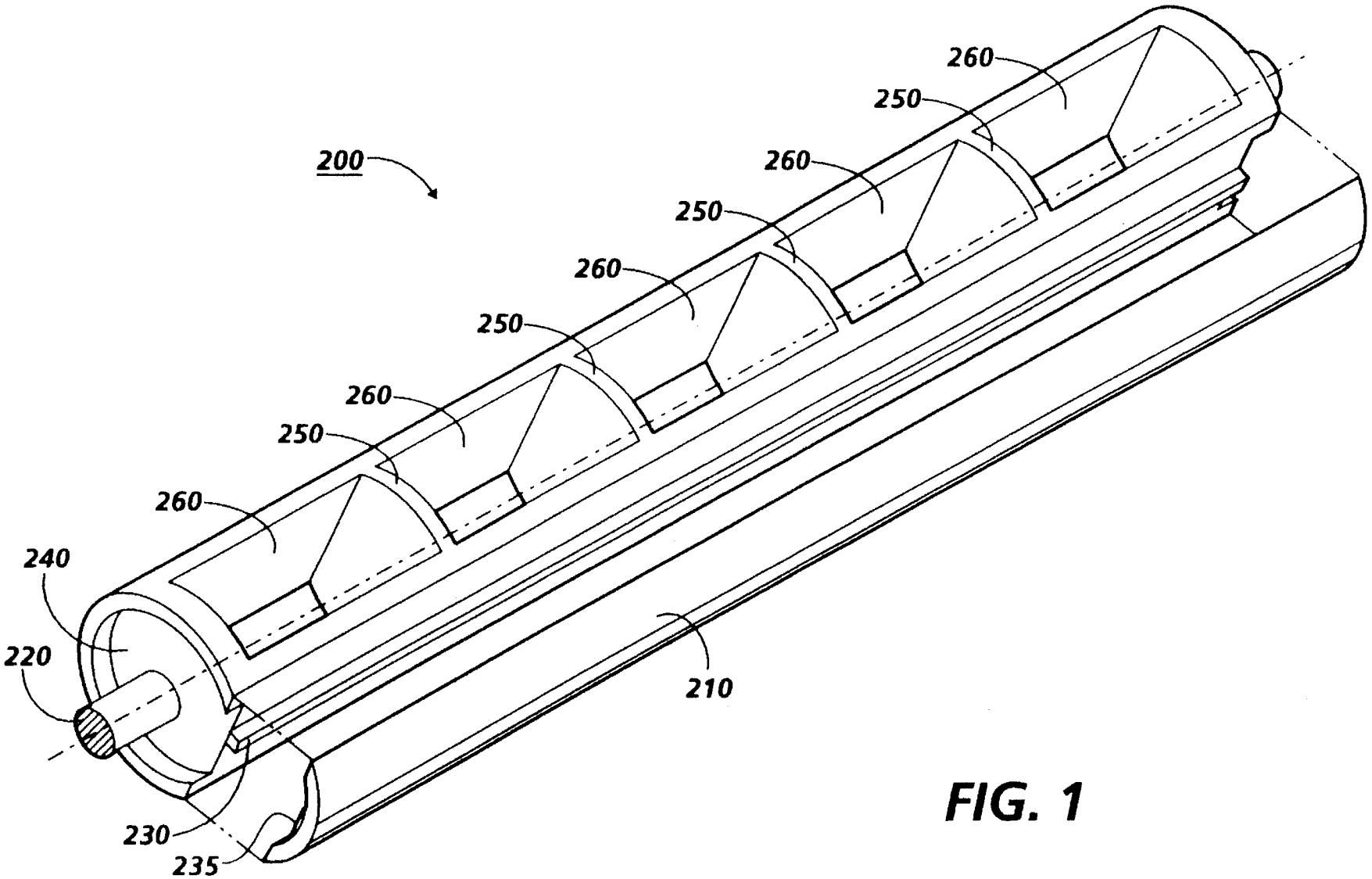
FIG. 1 is a perspective view of a main valve of the present invention.

Referring now to FIG. 1, which shows an isometric schematic side view of the main valve of the present invention. The main toner valve 200 is made up of a long round shaft 220 that has alignment, support, and sealing features on both ends as well as toner-through-holes 260 to allow toner to pass through when the main valve 200 is in an open position. The main valve 200 also contains an alignment rib 230 across the bottom surface of the main valve 200. The alignment rib 230 assists in alignment of the waste container upon insertion into the xerographic module and provides a way to carry the lid 210 as shown in FIG. 3A out of the waste container top and into the cleaner bottom when the valve is opened, and provides greater stiffness along the cleaner length. Additionally, four support ribs 250 are added to the inside of the main valve opening to ensure greater strength and uniformity along the length of the main toner valve 200 (see FIGS. 1–6).

Figure 2:
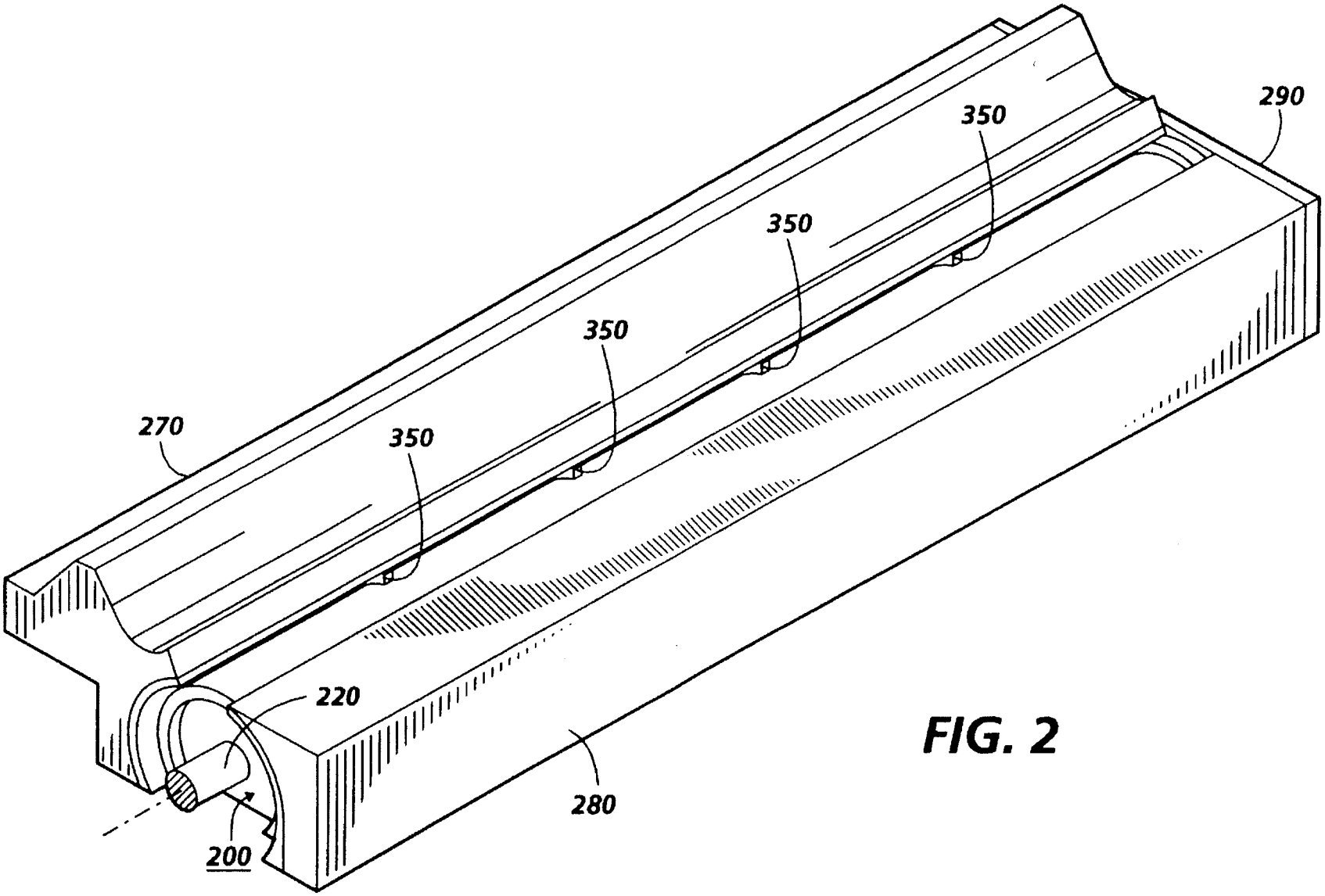
FIG. 2 is a perspective view of the FIG. 1 main valve enclosed in a housing of a cleaner unit.
Figures 3A, 3B:
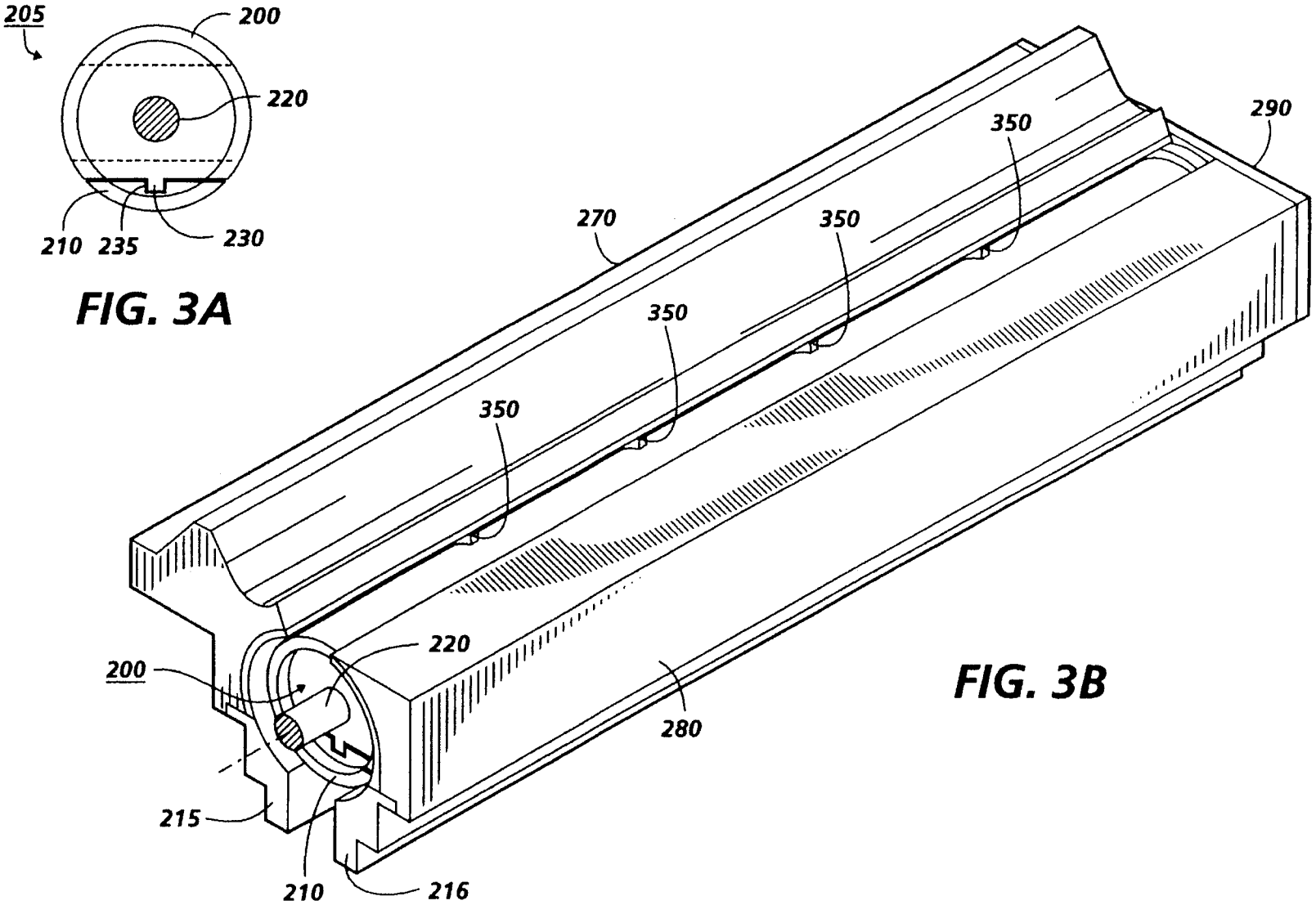
FIG. 3A is a schematic elevational view of the FIG. 1 main valve coupled to a lid.
FIG. 3B is a perspective view of the FIG. 1 main valve and the lid enclosed by the housings of the cleaner unit and the waste container.

Reference is now made to FIG. 2, which shows a schematic top view of the main valve of FIG. 1 enclosed in the housing of the cleaner. This figure provides a visual showing of the main toner valve 200 enclosed by the left 270 and right 280 housings of the cleaner. The cleaning device (not shown) is located above the main valve 200. The inboard end plate 290 of the housing is also shown.

Figure 4:
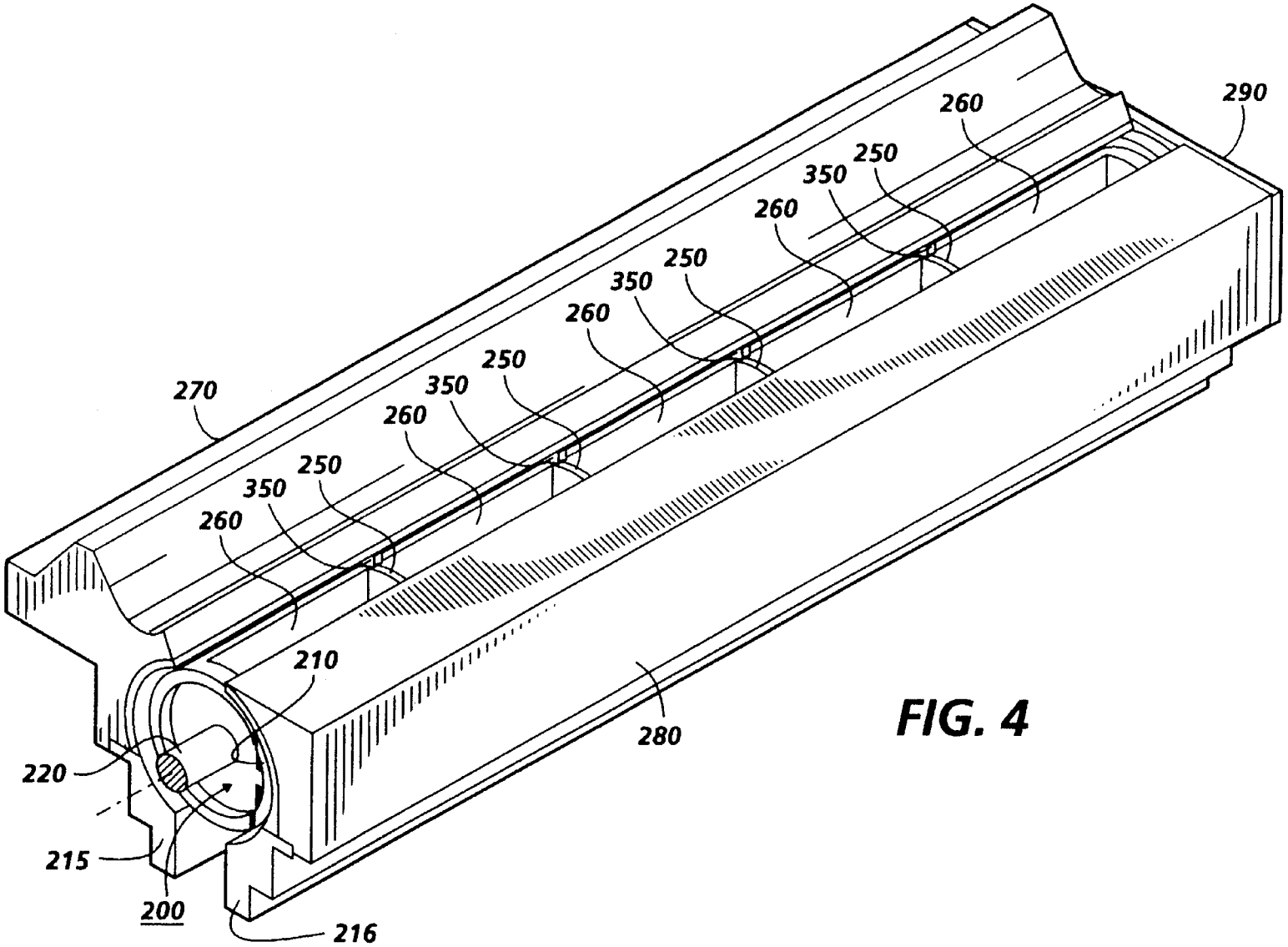
FIG. 4 is a schematic illustration showing the FIG. 1 main valve with the lid coupled thereto rotated 90 degrees counter-clockwise.

Reference is now made to FIG. 3A, which shows an end view of the main valve 200 coupled to a lid 210. The alignment rib 230 of the main valve fits into an alignment rib recess 235 of the lid. Referring now to FIG. 3B, which shows a schematic of the main valve 200 and the lid 210 enclosed by the housings of the cleaner and the waste container. When the top portion of the waste container is inserted into the main valve housings 270, 280, the lid 210, located in the top of the waste container, is mated with the main valve 200 which is located in the base of the cleaner apparatus. The main valve 200 and the lid 210 mate together to form a complete valve 205 (as shown in FIG. 3A). When the complete valve 205 is rotated 90 degrees counter-clockwise (see FIG. 4), the main valve 200 carries the lid 210 out of the waste container top and up into the bottom of the cleaner, as shown in FIG. 4. This 90 degree rotation provides openings (i.e. moves the toner through-holes 260 (see FIG. 1) into an open position, that is from a horizontal position to a vertical position over the waste container) for the toner to fall from the cleaner into the waste container (see FIG. 4). An advantage of the present invention is that the two exposed surfaces, meaning the bottom of the main valve 200 and the top of the lid 210, are tucked away inside the bottom of the cleaner and therefore are not exposed to toner particles. This is important particularly for customer applications because when the valve 205 is closed and a customer pulls the waste bottle or container out, the two surfaces being devoid of toner can not spill toner particles on the customer. The waste container is removed from the cleaning apparatus by simply rotating the complete toner valve (205) 90 degrees clockwise (i.e. opposite rotation to that used to open the valve), using the handle shaft 220. The rotation of the complete valve 90 degrees clockwise reseals the waste container with the lid 210. Then the waste container can then be removed from the cleaner apparatus without toner spillage.

With continuing reference to FIG. 3A, two spring loaded pins (not shown) are located below the main valve 200 surface that contains an alignment rib 230 along it's length. When the waste container is inserted into the brackets 360 (see FIG. 9B) of the cleaner housing, located below the main valve 200, the spring loaded pins are pushed back into the housing. These spring loaded pins prevent movement of the main valve 200 and movement of the handle 219 (see FIG. 9A), when the waste container is not inserted into the cleaner housing, that would allow the toner particles to fall from the cleaner housing into other operations of the xerographic module (i.e. charge corotron, paper trays, optics . . . ). (It is important to keep the other operations of the xerographic module clean and free from contamination by toner particles to avoid operation failures.) When the waste container is not present, toner leakage from the cleaner housing is prevented due to sealing contact provided between the main valve and the opening of the cleaner housing adjacent thereto. When these pins have been pushed back by the inserted waste container, the handle can now be turned to open the toner valve, allowing the toner particles to flow into the waste container.

Figure 5:
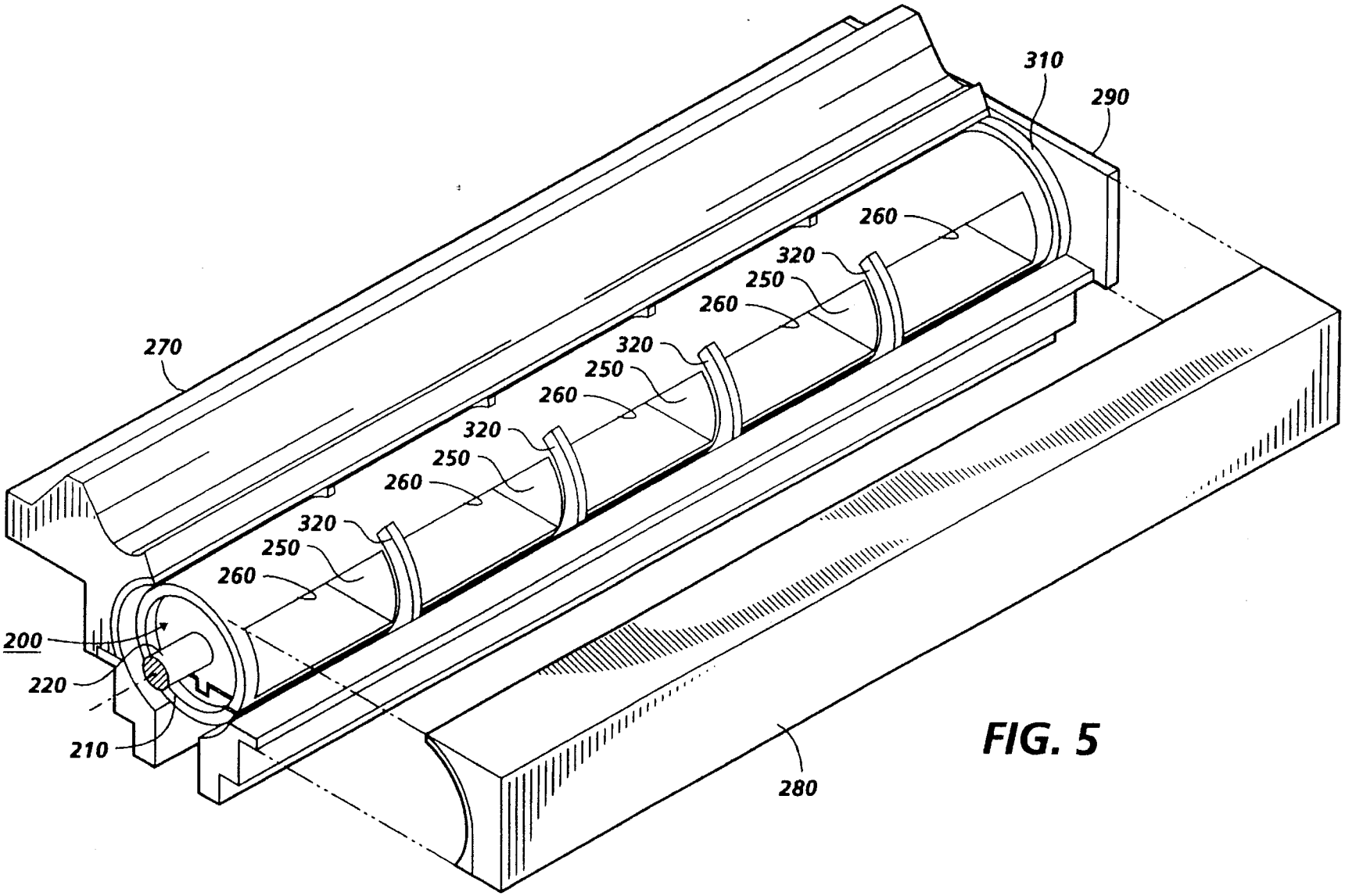
FIG. 5 is a schematic illustration showing the FIG. 1 main valve with the right portion of the housing removed therefrom.

Referring now to FIG. 5, which shows the main valve with the right portion of the cleaner housing removed. In order to properly distribute the stresses associated with opening and closing the complete valve 205, the main valve 200 must be properly reinforced. Uniform support rings 310 are located around each end of the main valve 200, along with C-shaped support ribs 320 about the main valve 200 circumference, and the support braces 330 (see FIG. 6) and the support ribs 250 (see FIG. 1) of the main valve 200 all line up to evenly distribute the stresses associated with opening and closing the main valve 200 in the housing.

Figure 6:
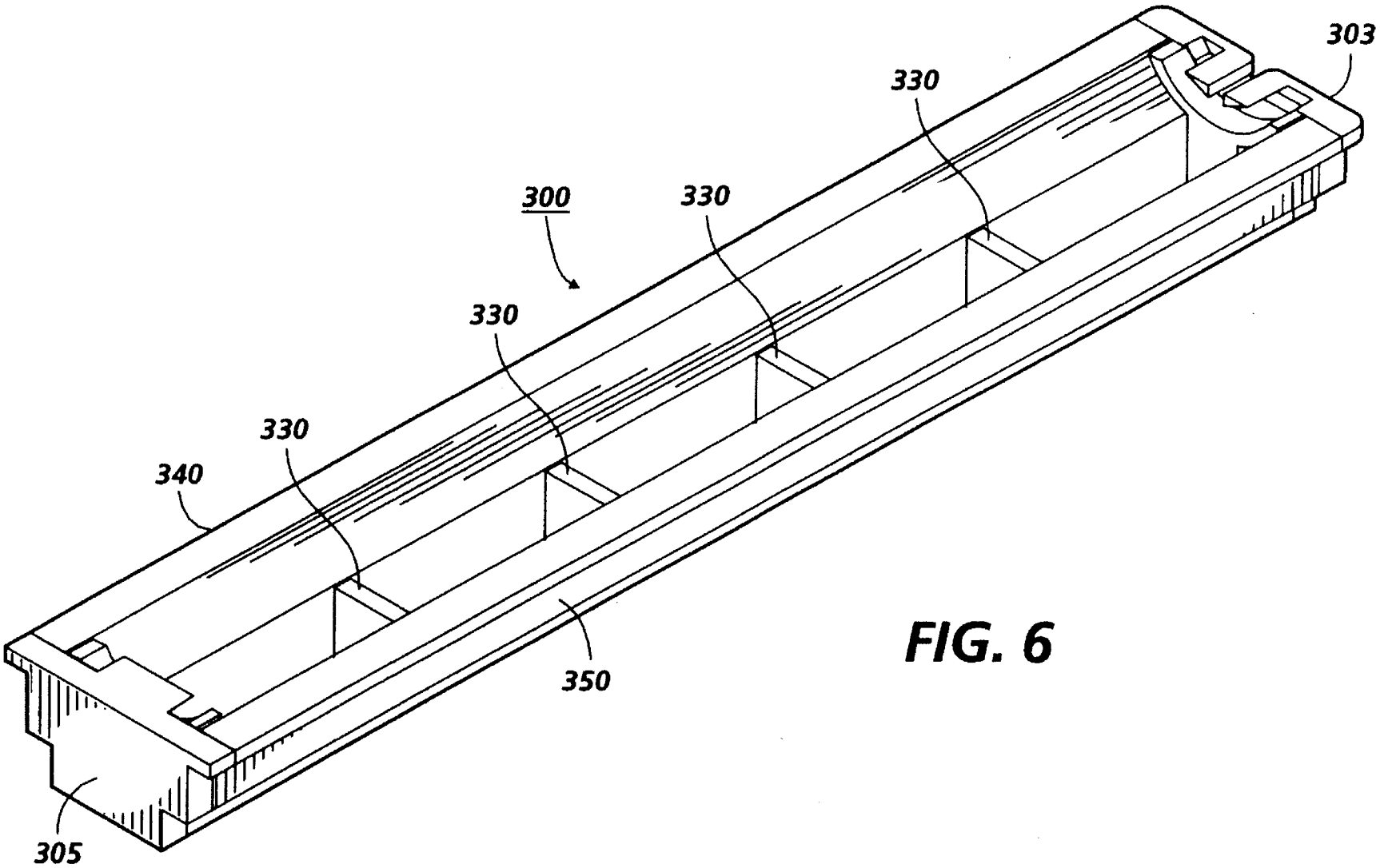
FIG. 6 is a schematic illustration showing a plan view of the waste container without the lid.

Referring now to FIG. 6 which shows a top view of the waste container without the lid. The waste container 300 includes an inboard waste container top end plate 303 and an outboard waste container top end plate 305 at opposite ends of the waste container 300. These end plates 303,305 provide support and prevent toner leakage from the waste container. Support braces 330 provide support to the waste container 300 along the length of the waste container 300. The support braces 330 are located between the top of the left waste container housing 340 and the top of the right waste container housing 350.

Figure 7:
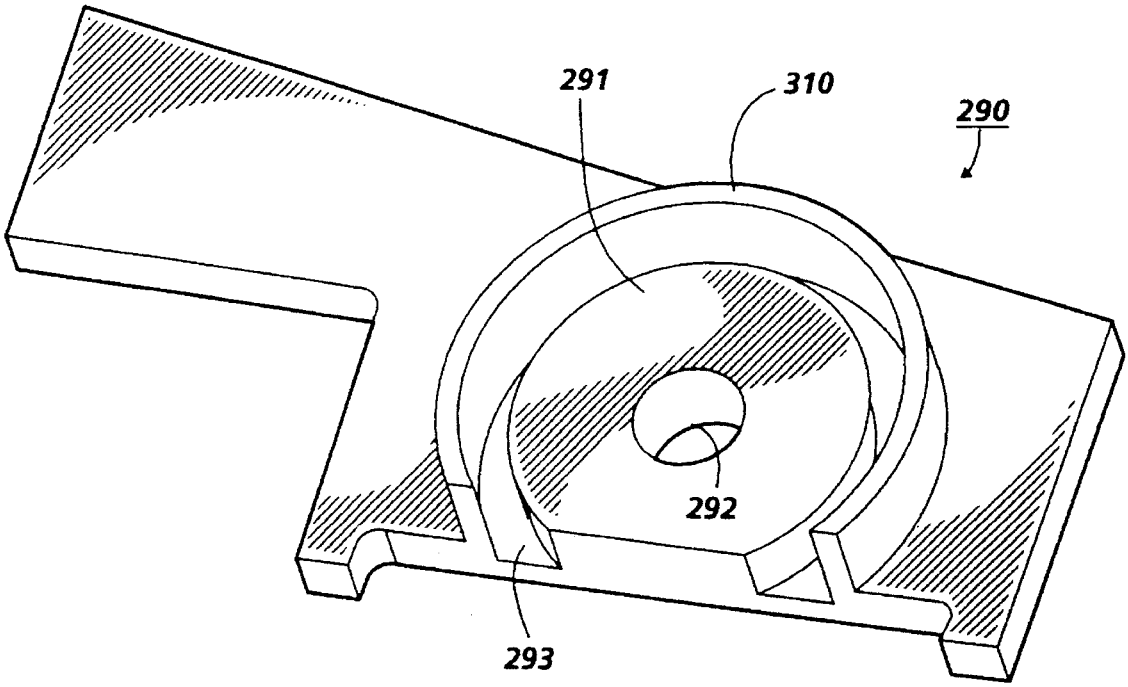
FIG. 7 is a schematic illustration showing an elevational view of an end plate of the main valve.

An important feature of the present invention, is the ability of the toner valve to effectively seal toner inside the cleaner and/or the waste container. Referring now to FIG. 7, which shows the inboard end plate 290 of the main valve. Toner particles are sealed at the ends via the recessed counter bore 293 in the end plates. A foam seal is placed in the counter bore 293 and compressed when the main valve is inserted into the end plate thus providing a tight seal. The support island 291 is where the main valve is inserted to create the tight seal. (It is noted that the counter bore recess hole 292 does not go all the way through. It is also noted that the outboard end plate of the main toner valve is a mirror image of the inboard end plate differing only in the recess hole labeled 292. The recess hole of the outboard end plate goes all the way through the end plate allowing for an external handle to be attached to the toner valve shaft 220 (see FIG. 1).)

Figure 8:
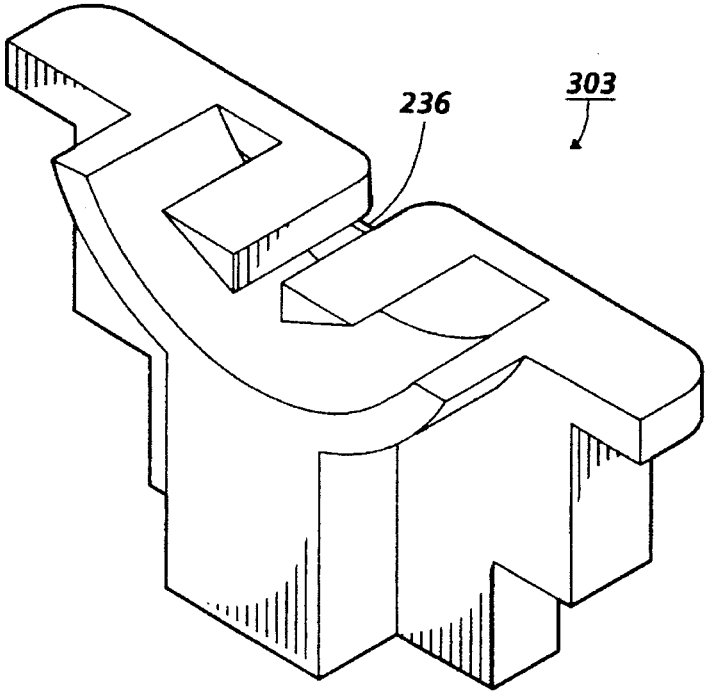
FIG. 8 is a schematic illustration of a plan view of the FIG. 7 end plate.

Referring now to FIG. 8, which shows a top view of the inboard end plate 303 of the waste container. Like the main valve, the toner particles will be sealed in at the ends of the top portion of the waste container by the end plates. Foam seals are glued to the inside of the cleaner housings in between the support ribs 320 (see FIG. 5) to seal in toner particles along the length of the main valve and lid. (It is noted that the outboard end plate for the waste container is a mirror image of the inboard end plate with one exception. The exception being that the outboard end plate for the waste bottle top does not contain a slot 236 (see FIG. 8) as shown for the inboard end plate.)

Figure 9A:
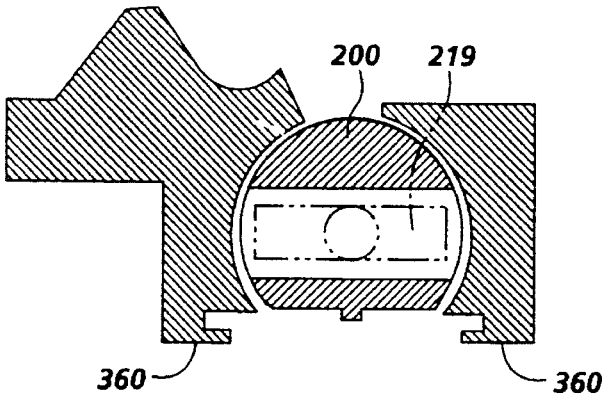
FIG. 9A is an elevational view of the main valve closed without the waste container attached.
Figure 9B:
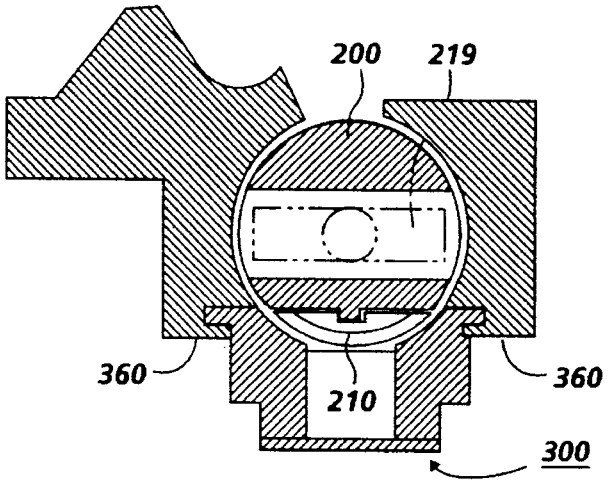
FIG. 9B is an elevational view of the main valve closed with the waste container attached.
Figure 9C:
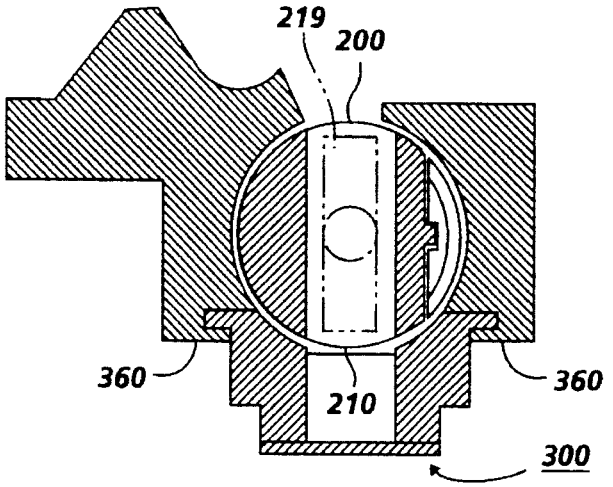
FIG. 9C is an elevational view of the main valve and the lid rotated 90 degrees to open the valve passageway to the waste container.

Reference is now made to FIGS. 9A–9C which show schematics of the complete valve operation steps. In FIG. 9A, an elevational view of the main valve in an initial closed position is shown. This schematic is prior to insertion of the waste container. The handle 219, attached to the handle shaft 220 (See FIGS. 1 and 3A), is shown in a horizontal position when the main valve 200 is closed. In FIG. 9B, the lid 210 and the waste container 300 have been inserted into the apparatus while the handle 220 is in the closed position. The waste container 300 is inserted onto the brackets 360 of the cleaner housing. In FIG. 9C, the handle 220 has been rotated counter-clockwise 90 degrees to align the toner through-holes to align with the waste container 300 to allow free fall of toner particles from the cleaner to the waste container. The toner valve apparatus of the present invention can be adapted to fit many different cleaners, as long as the sealing, support, and valve design remain the same.

Other applications of the present invention are as follows. Some waste toner bottles are located at a location remote from the cleaner. In these cases a spiral auger is often used to transport the waste toner from the cleaner housing to the waste bottle (eg., Xerox 1075 machine). The problems in sealing a waste bottle to an auger are essentially the same as those encountered in sealing a waste bottle to a cleaner therefore, it is necessary for the waste bottle to be sealed and remain clean. It is also necessary for the auger to be sealed when the waste bottle is removed to prevent toner from falling into the xerographic machine. It is also necessary that the auger be capable of sealing the waste bottle in the event of a waste bottle overfill. Placing the toner valve, of the present invention, below the auger enables these sealing requirements to occur.

Alternatively, the auger could be located in the center of the toner valve. In this case, the main toner valve would be open at the end opposite the valve handle to allow the auger tube to enter the valve and the openings at the top of the toner valve to be eliminated. The waste bottle and lid would slide into engagement with the toner valve. The toner valve handle would then be rotated 90° to align the single set of valve openings with the auger exit openings and the waste bottle entrance. The operations of the toner valve associated with an auger are identical to those operations discussed above in association with the cleaner, with an exception. The exception being that the toner flows from the center of the toner valve out of the waste auger rather than through the valve from the cleaner housing.

Another embodiment of the present invention is that the toner valve can also be used to seal a toner input bottle to a toner dispenser housing as well as to a waste toner bottle to the cleaner. In a toner input bottle application, a full bottle of toner must be turned upside down and sealed to the toner dispenser housing. This seal must be able to prevent toner from leaking, allow for easy flow of the toner from the bottle into the dispenser and enable the bottle to be removed from the dispenser housing without allowing any toner to escape. Some existing configurations (e.g., Xerox 5090 machine, Xerox 1065 machine) have a lid which seals the bottom of the waste bottle using foam seals and a mechanical interlock to hold the lid onto the bottle. The bottle is turned upside down and the lid positioned on the dispenser housing. The bottle is then pushed off of the lid, which is held by features on the dispenser housing, until it is located over the top of the dispenser entrance. With the lid removed, the toner in the bottle is free to flow down into the dispenser entrance where it is then delivered to the developer housing as required. Preferably the bottle is not removed from the dispenser housing until it is empty. Then the bottle is pulled back onto the lid and lifted from the dispenser housing with the lid reattached. When the toner bottle has been removed from the dispenser housing the dispenser entrance is exposed allowing both toner to escape and contamination to enter the dispenser. The lid at the bottom of the toner bottle is usually relatively free of toner on exposed surfaces, but after repeated uses the dispenser tends to become dirty and transfer toner to the lid as it is removed. If the toner bottle is removed before it has been completely emptied large amounts of toner are usually deposited on the outside of the bottle and lid.

In the present invention, the toner valve seals the toner input bottle by attaching the toner valve lid to the bottom of the toner input bottle in the same manner in which it is attached to the top of a waste toner bottle, described above. The toner valve consists of the same hardware, but is rotated 180° such that the features to engage the bottle lid are now on the top of the bottle. The toner input bottle would be slid onto the top of the dispenser housing so that the lid is engaged in the toner valve. The toner valve handle is rotated 90° to remove the lid from the bottom of the toner bottle and open the valve to allow toner to flow into the dispenser entrance. Reversing the procedure reinstalls the toner input bottle lid and closes the dispenser entrance. The toner input bottle is then removed with both the bottom of the bottle and the dispenser sealed and clean. Rotating the toner valve to the closed position while the toner input bottle still contains toner does not result in toner contamination to the exterior surfaces of the bottle or allow contaminants to enter the dispenser housing.

In recapitulation, the present invention discloses using a toner valve to seal the interface between the bottom of a cleaner apparatus and a waste bottle container. The toner valve is a two piece construction including: a main valve, being housed in the cleaner housing; and a lid, being housed in the top portion of the waste container. When the waste container is inserted into the copier and a handle is rotated, the two pieces of the toner valve construction work as one to open the waste container and provide a totally sealed, open path for toner to fall from the cleaner into the waste bottle container. This apparatus is simple to operate (i.e. because of a two step process with self alignment features), and maintains clean external surfaces and thus allows the waste bottle container to be easily replaced by the customer. Other advantages of the present invention include the ability of the toner valve apparatus: to be adapted to any gravity fed toner collection cleaning system; to be reused in a new copier if the seals are replaced; to prevent toner emissions due to the seals; and to allow the waste bottle to become a CRU (customer replaceable unit) without risk of toner spillage on the customer when the waste bottle container is replaced. The risk of toner spillage is alleviated due to the concept of the toner valve of the present invention, in which the two pieces (i.e. the main valve and the lid) come together to act as one and provide an effective seal between a cleaner and waste bottle container. However, in addition to an effective seal, the toner valve can be used as the interface between the cleaner and waste container on any cleaner that utilizes gravity feed toner collection.

It is therefore apparent, that there has been provided in accordance with the present invention, a cleaner/waste container toner valve that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A printing apparatus for cleaning particles from a surface, comprising:

means for cleaning particles from the surface;

a housing defining a chamber having a first open end and a second open end, said cleaning means being mounted in the chamber of said housing with a portion thereof being adapted to extend from the first open end of the chamber into contact with the surface;

a waste container, attached to the second open end of said housing, for collecting particles removed from the surface by said cleaning means; and means, rotatably movable between a closed position and an open position, for sealing the second open end of said housing and said waste container, said sealing means comprising a main valve enclosed in the housing between said cleaning means and said waste container, and a lid being movable when directly coupled to said main valve, said lid located between said main valve and said waste container, said main valve and said lid being coupled having simultaneous movement for opening the second open end of said housing and said waste container.

2. A printing apparatus for cleaning particles from a surface, comprising;

means for cleaning particles from the surface;

a housing defining a chamber having a first open end and a second open end, said cleaning means being mounted in the chamber of said housing with a portion thereof being adapted to extend from the first open end of the chamber into contact with the surface;

a waste container, attached to the second open end of said housing, for collecting particles removed from the surface by said cleaning means; and means, movable between a closed position and an open position, for sealing the second open end of said housing and said waste container, said sealing means comprising a main valve enclosed in the housing between said cleaning means and said waste container, and a lid being movable when coupled to said main valve, said lid located between said main valve and said waste container said main valve comprises a plurality of support ribs, said support ribs defining a plurality of through-holes in said main valve for the particles removed from the surface to pass therethrough.

3. An apparatus as recited in claim 2, wherein, responsive to said sealing means being in the open position, said main valve being out of sealing contact with the second open end, with the through-holes being aligned adjacent to said waste container, enabling particles to pass therethrough, and said lid, coupled to said main valve, being out of sealing contact with said waste container, enabling particles removed from the surface to pass from said housing to said waste container.

4. An apparatus as recited in claim 3, wherein, responsive to said sealing means being in the closed position, said main valve being in sealing contact with the second open end, with the through-holes being non-aligned with said waste container, preventing particles from exiting said housing, and said lid, coupled to said main valve, being in sealing contact with said waste container, preventing the particles from exiting said waste container thereby preventing spillage of the particles from said waste container.

5. An apparatus as recited in claim 4, wherein said main valve comprises:

a shaft centrally located in said main valve; and a handle coupled to said shaft to move said main valve between the open position and the closed position.

6. An apparatus as recited in claim 5, further comprising, an alignment rib extending along a surface of said main valve, said lid defining a recess extending along a surface thereof and being adapted to receive said rib upon connecting said waste container with said housing.

7. A method of sealing an interface between a cleaner housing and a waste container, comprising:

coupling the waste container and the cleaner housing of a printing machine to one another;

opening the interface between the cleaner housing and the waste container, simultaneously, enabling particles to flow from the cleaner housing to the waste container; the step of opening the interface comprising directly connecting a main valve in the cleaner housing to a lid in the waste container during said coupling step, and rotatingly moving the main valve to an open position to urge the lid to an open position;

closing the interface between the cleaner housing and the waste container to prevent particles from escaping the cleaner housing and the waste container; and separating the waste container and cleaner housing from one another.

8. A method as recited in claim 7, wherein the step of closing the interface comprises moving the main valve to a closed position to urge the lid to a closed position.

9. A cleaning unit having an operator replaceable waste container adapted to collect particles cleaned from a surface, comprising:

a device for cleaning particles from the surface;

a housing defining a chamber having a first open end and a second open end, said cleaning device being mounted in the chamber of said housing with a portion thereof being adapted to extend from the first open end of the chamber into contact with the surface;

the waste container being attached to the second open end of said housing, for collecting particles removed from the surface by the cleaning device; and a device, rotatably movable between a closed position and an open position, for sealing the second open end of said housing and the waste container, said sealing device comprising a main valve enclosed in the housing between the cleaning device and the waste container, and a lid being movable when directly coupled to said main valve, said lid located between said main valve and the waste container, said main valve and said lid being coupled having simultaneous movement for opening the second open end of said housing and said waste container.

10. A cleaning unit having an operator replaceable waste container adapted to collect particles cleaned from a surface, comprising:

a device for cleaning particles from the surface;

a housing defining a chamber having a first open end and a second open end, said cleaning device being mounted in the chamber of said housing with a portion thereof being adapted to extend from the first open end of the chamber into contact with the surface;

the waste container being attached to the second open end of said housing, for collecting particles removed from the surface by the cleaning device; and a device, movable between a closed position and an open position, for sealing the second open end of said housing and the waste container, said sealing device comprising a main valve enclosed in the housing between the cleaning device and the waste container, and a lid being movable when coupled to said main valve, said lid located between said main valve and the waste container wherein said main valve comprises a plurality of support ribs, said support ribs defining a plurality of through-holes in said main valve for the particles removed from the surface to pass therethrough.

11. A cleaning unit as recited in claim 10, wherein, responsive to said sealing device being in the open position, said main valve being out of sealing contact with the second open end, with the through-holes being aligned adjacent to the waste container enabling the particles to pass therethrough, and said lid, coupled to said main valve, being out of sealing contact with the waste container, enabling particles removed from the surface to pass from said housing to the waste container.

12. A cleaning unit as recited in claim 11, wherein, responsive to said sealing device being in the closed position, said main valve being in sealing contact with the second open end, with the through-holes being non-aligned with the waste container preventing particles from exiting said housing, and said lid, coupled to said main valve, being in sealing contact with the waste container, preventing the particles from exiting the waste container thereby preventing spillage of the particles from the waste container.

13. A cleaning unit as recited in claim 12, wherein said main valve comprises:

a shaft centrally located in said main valve; and a handle coupled to said shaft to move said main valve between the open position and the closed position.

14. A cleaning unit as recited in claim 13, further comprising an alignment rib extending along a surface of said main valve, said lid defining a recess extending along a surface thereof being adapted to receive said rib upon connecting the waste container with said housing.

15. A cleaning unit as recited in claim 14, wherein said handle is rotatable.

16. A cleaning unit as recited in claim 15, wherein said handle rotates 90 degrees between the closed position and the open position.

* * * * *